United States Patent [19]

Hand, Sr.

[11] Patent Number: 4,792,125

[45] Date of Patent: Dec. 20, 1988

[54] CONSUMABLE LANCE

[75] Inventor: Evan L. Hand, Sr., Hummelstown, Pa.

[73] Assignee: Bethlehem Steel Corporation, Bethlehem, Pa.

[21] Appl. No.: 88,449

[22] Filed: Aug. 24, 1987

[51] Int. Cl.[4] ..... C21C 5/48

[52] U.S. Cl. ..... 266/266; 266/225

[58] Field of Search ..... 266/225, 267, 268, 266, 266/270

[56] References Cited

U.S. PATENT DOCUMENTS

| | | | |
|---|---|---|---|
| 2,829,879 | 4/1958 | Kosmider et al. | 266/224 |
| 3,645,520 | 2/1972 | Acre et al. | 266/225 |
| 3,976,286 | 8/1976 | Thompson et al. | 266/225 |
| 4,084,800 | 4/1978 | Butts et al. | 266/225 |
| 4,399,985 | 8/1983 | Eastwood | 266/265 |
| 4,550,898 | 11/1985 | LaBate | 266/225 |

FOREIGN PATENT DOCUMENTS

| | | | |
|---|---|---|---|
| 2123535 | 2/1984 | United Kingdom | 266/225 |

*Primary Examiner*—L. Dewayne Rutledge
*Assistant Examiner*—Robert L. McDowell
*Attorney, Agent, or Firm*—John I. Iverson

[57] ABSTRACT

A consumable lance for introducing oxygen into molten metal. The lance is designed so that tubular oxygen passageways melt at a relatively low temperature thereby exposing refractory passageways and significantly improving the wear resistance of the lance.

9 Claims, 1 Drawing Sheet

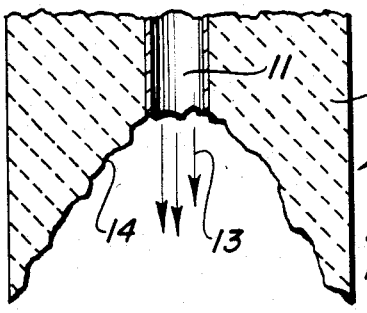
FIG. 1
PRIOR ART
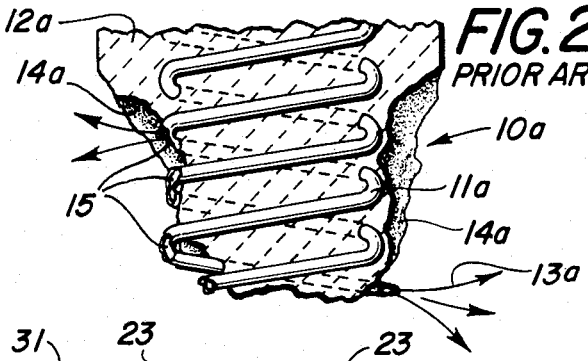
FIG. 2
PRIOR ART
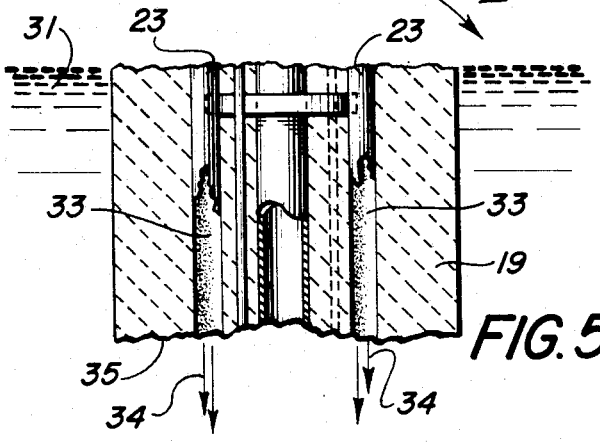
FIG. 5
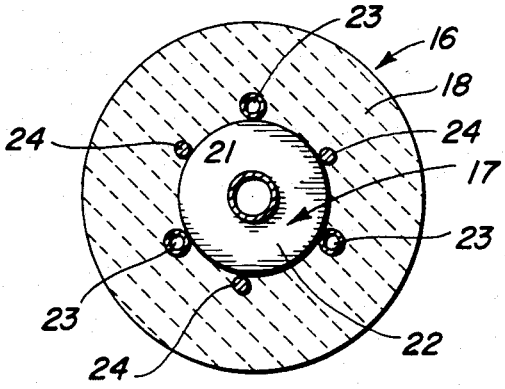
FIG. 4
FIG. 3
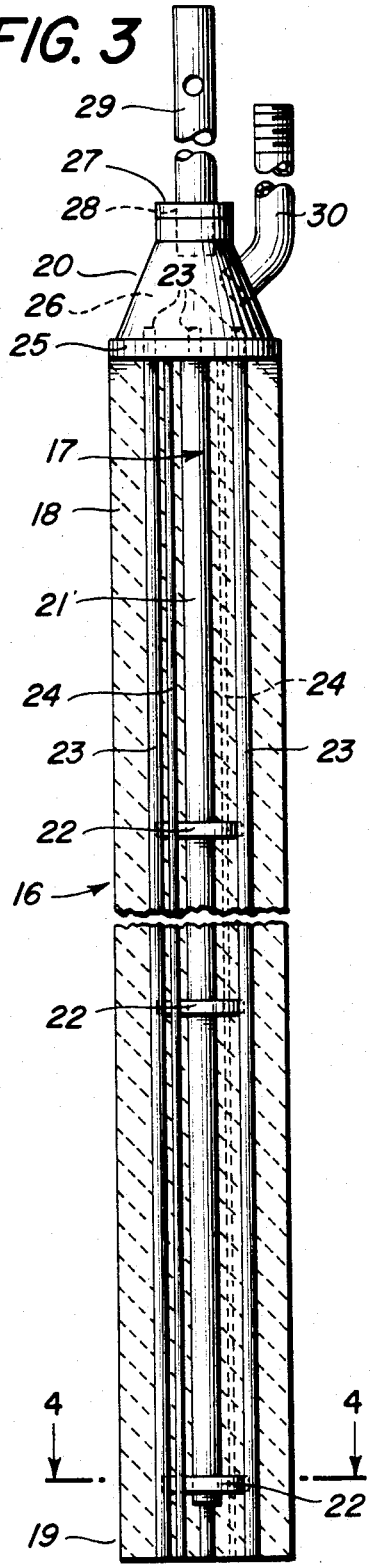

CONSUMABLE LANCE

BACKGROUND OF THE INVENTION

This invention relates to elongated tubular devices which are immersed into molten liquid metal. It relates specifically to the construction of consumable lance devices used to introduce oxygen or other gases into molten steel.

In metallurgical operations using continuous casting machines it has become necessary to tap the heats "hot" from the furnaces to insure sufficient temperature at delivery to the caster. Missed caster sequences require either (a) diverting pours into ingots, with the consequence of lower quality steel and higher production costs, (b) providing a ladle reheat furnace for raising the temperature of the liquid steel in the ladle or (c) blowing oxygen into the liquid steel through an oxygen lance to raise the temperature of the liquid steel to the required casting temperature. Heretofore, it has been the practice to use either water-cooled nonconsumable lances or refractory covered consumable lances during such oxygen blowing reheating operations.

Consumable lances in the past have used several designs. The first design injects oxygen into the molten steel bath through a centrally located longitudinal tubular steel member encased within a protective refractory covering.

Another design, as taught in U.S. Pat. No. 3,645,520, injects oxygen into the molten steel bath through a plurality of spirally wound tubular copper members encased within a protective refractory covering. Such spirally wound passageways have been developed to reduce or eliminate splash as the oxygen is injected into high carbon liquid steel.

As oxygen is injected into the liquid steel bath, the combination of high temperatures, and the rapid flow of oxygen through and around the tubular passageways and supporting structures of the aforementioned consumable lances, causes lance tip erosion at a rate of up to 12 inches/min. Such high erosion rates make it necessary to manufacture reheating lances with excessively long consumable tip portions. For example, in reheating a ladle, it may be necessary to increase the temperature of the liquid steel up to 50° F. With a reheat rate of 5° F. to 10° F. per minute, and a lance wear rate of up to 12 inches/min., it is possible to consume 10 feet of reheating lance during a single reheating operation.

SUMMARY OF THE INVENTION

It is therefore an object of this invention to provide a consumable lance having improved wear resistance thereby extending lance life.

It is a further object of this invention to provide a design for a consumable lance in which refractory passageways are formed as tubular members are sacrificed when they are exposed to the high temperatures of the molten bath.

It is a still a further object of this invention to provide a design for a consumable lance or a similar device in which the internal structural support assembly is subjected to minimal exposure to the oxygen being injected into the liquid steel bath.

I have discovered that the foregoing objects can be attained with a consumable lance comprising a plurality of longitudinal gas conduits radially spaced about a longitudinal structural support assembly and encased within a protective refractory covering, an upper end portion having a manifold system for disbursing gas into a molten metal bath and a lower end portion to be immersed into and consumed by such molten metal bath.

BRIEF DESCRIPTION OF THE DRAWINGS

FIG. 1 is a cross-sectional view of a prior art lance illustrating the erosion encountered at the lance tip when ferrous tubular members are used as oxygen passageways.

FIG. 2 is a similar cross-sectional view of a prior art lance illustrating the erosion encountered at the lance tip when spirally wound tubular members are used as oxygen passageways.

FIG. 3 is an elevational view in cross-section of the preferred embodiment of this invention.

FIG. 4 is a cross-sectional view of the present invention taken along the lines 4—4 of FIG. 3.

FIG. 5 is a cross-sectional view similar to that of FIGS. 1 and 2 illustrating the improved erosion characteristics at the lance tip of the present invention.

DETAILED DESCRIPTION OF THE PREFERRED EMBODIMENT

Before describing the unique design of the consumable reheating lance of this invention, it will be helpful to review the problems of the prior art.

Referring to FIG. 1 of the drawings, a consumable reheating lance tip 10 is seen to comprise one or more elongated tubular steel members 11 encased within a protective refractory covering 12. The tubular steel members 11 are connected to an oxygen source, not shown, and provide passageways through which oxygen 13 is injected into the molten steel bath. During actual use in reheating operations, it was discovered that the reaction between the oxygen 13 and the tubular steel members 11 in combination with the high temperatures of the reheating operation caused excessive concave erosion 14 at the lance tip resulting in lance consumption at a rate of from 5.5 inches/min. to 15.4 inches/min. It was also discovered that "straight through lances", as shown in FIG. 1, performed satisfactorily when reheating low carbon grades of steel (below about 0.50% C), but produced heavy splash when higher carbon steels were reheated.

In an effort to overcome the problem of heavy splash produced during the reheating of high carbon steels (above about 0.50% C) a second design, as described in U.S. Pat. No. 3,645,520, was tried. This second design, illustrated in FIG. 2, comprises a consumable lance tip **10*a* having one or more spiral tubular members 11*a* encased within a protective refractory covering 12*a*. The angle of the spiral tubular members 11*a* is controlled so that as the lance is consumed the oxygen 13*a* will be injected into the molten steel at a predetermined selected angle. U.S. Pat. No. 3,645,520 teaches that a gas injection angle of 15° to 90° from the vertical will produce a minimal splashing effect. However, it has been discovered that as the gas is injected into the molten bath at the above selected angles, it causes uneven erosion of the protective refractory covering, as shown at 14*a* in FIG. 2. This erosion exposes the tubular members 11*a* a to the molten bath and causes up line burn through 15 of the tubular members 11*a*** thereby intensifying the erosion of the protective covering. Such lances have been consumed at a rate of about 9.4 inches/min.

Referring to FIGS. 3 and 4 illustrating the reheating lance of this invention, a consumable lance 16 is comprised of a longitudinal structural support assembly 17 encased within a protective refractory covering 18, a consumable lower end portion 19 and an upper manifold end portion 20.

The longitudinal structural assembly 17 consists of an innermost longitudinal member 21 extending from the lower end portion 19 to the underside of a first manifold cover plate 25. The innermost longitudinal member 21, which may be either tubular or solid, is attached to the underside of plate 25 by welding or some other means and is effectively sealed off from the manifold chamber 26 to prevent its use as a gas conduit or passageway between the manifold system of the upper end portion 20 and lower end portion 19. A series of circular spacer members 22 having a centrally located aperture of sufficient size to enclose innermost longitudinal member 21 are spaced along and fastened to the innermost longitudinal member 21 by welding or some other means. A plurality of longitudinal bar or rod like members 24, extending between the lower end portion 19 and upper end portion 20, are radially spaced about the innermost longitudinal member 21 and fastened to the circular spacer members 22 by welding or some other means.

A plurality of elongated sacrificial tubular members 23 are radially spaced about the longitudinal structural support assembly 17 and attached to the circumference of the circular spacer members 22. The sacrificial tubular members 23 and the rod like members 24 are alternately spaced about the innermost longitudinal member 21 and the tubular members 23 extend from the lower end portion 19 through the first manifold cover plate 25 and into the manifold chamber 26 thereby providing gas conduits or passageways between the manifold system of upper end portion 20 and lower end portion 19.

The elongated sacrificial tubular members 23 of the preferred embodiment are made from copper. However the sacrificial tubular members 23 may be made from any similar material having a melting point of less than about 2000° F.

A second manifold cover plate 27, provided with a threaded connection 28 for attachment to rod 29 of a lance raising and lowering device not shown, seals off the top side of the manifold system of upper end portion 20. Oxygen is supplied to the manifold chamber 26 through a feed line 30 connected to an oxygen supply source not shown, and the oxygen is distributed to the lower end portion 19 through the elongated sacrificial tubular members 23.

Referring to FIG. 5, as the lower end portion 19 is immersed into the molten metal bath 31 oxygen 34 is injected into the metal bath through the elongated sacrificial tubular members 23. The lower portion of sacrificial tubular members 23, which are exposed to the high temperatures of the reheating process, melt back away from the high temperature zone and refractory passageways 33 are created within the lower end portion 19. It has been discovered that such melt back of the sacrificial tubular members 23 and creation of refractory passageways 33 in combination with locating the refractory passageways 33 as far as possible from the longitudinal structural support assembly 17, results in an even erosion pattern at the lower end portion 19 of the consumable lance 16 and reduces the lance consumption rate to about 3.3 inches/min.

Using the same reheating parameters as set forth in describing the prior art, the required 50° F. increase in bath temperature would only consume 1.5 to 3 feet of a lance as described by this invention. Such a consumption rate significantly extends the lance life of the invention.

Although the innermost longitudinal member 21 and longitudinal bar or rod like members 24 of the preferred embodiment are shown to have circular cross-sections, it should be understood that any suitable cross-section may be used for such members. And, although the longitudinal bar or rod like members 24 of the preferred embodiment are shown attached to the circumfernce of the circular spacer members 22, it should be understood that the longitudinal bar or rod like members 24 could be attached to the circular spacer members 22 at any point along the radius of such circular spacer members.

I claim:

1. A consumable lance for injecting a gas into a molten metal bath, said lance comprising:
   (a) a longitudinal structural support assembly encased within a protective refractory covering,
   (b) a plurality of longitudinal gas conduits within said refractory covering and radially spaced about said structural support assembly,
   (c) a lower end portion adapted to be immersed into and consumed by said molten metal bath, and
   (d) an upper end portion having a manifold system for disbursing said gas into the molten metal bath through said conduits where the longitudinal structural assembly (a) includes a closed innermost longitudinal structural member extending between the lower end portion (c) and the upper end portion (d) a series of circular spacer members spaced along the length of said closed innermost longitudinal structural member and a plurality of longitudinal bar members radially spaced about said closed innermost longitudinal structural member between adjacent gas conduits and fastened to the periphery of said circular spacer members.

2. The apparatus of claim 1 in which the plurality of longitudinal gas conduits (b) are tangent to the periphery of the circular spacer members of the longitudinal structural support assembly (a).

3. The apparatus of claim 2 in which the longitudinal gas conduits comprise sacrificial tubular members made from a material having a melting point of less than about 2,000 degrees F.

4. The apparatus of claim 3 in which the sacrificial members are made of copper.

5. The apparatus of claim 3 in which the sacrificial tubular members and bar members of the longitudinal support assembly are alternately and radially spaced about the innermost longitudinal structural member of said longitudinal support assembly.

6. The apparatus of claim 3 in which the sacrificial tubular members are fastened to the periphery of the circular spacer members.

7. The apparatus of claim 3 whereby the sacrificial tubular members melt back away from the lower portion (c) as the lance is immersed into a molten metal bath thereby creating refractory conduits or passageways through which gas is injected into said molten metal bath.

8. The apparatus of claim 7 whereby the molten metal bath is steel.

9. The apparatus of claim 7 whereby the gas is oxygen.

* * * * *